US009869154B2

(12) United States Patent
O'Malley et al.

(10) Patent No.: US 9,869,154 B2
(45) Date of Patent: Jan. 16, 2018

(54) APPARATUS AND METHODS FOR CLOSING FLOW PATHS IN WELLBORES

(71) Applicants: Edward O'Malley, Houston, TX (US); Beau R. Wright, Tomball, TX (US); Juan C. Flores, The Woodlands, TX (US)

(72) Inventors: Edward O'Malley, Houston, TX (US); Beau R. Wright, Tomball, TX (US); Juan C. Flores, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 501 days.

(21) Appl. No.: 14/553,524

(22) Filed: Nov. 25, 2014

(65) Prior Publication Data

US 2016/0145969 A1 May 26, 2016

(51) Int. Cl.
*E21B 33/13* (2006.01)

(52) U.S. Cl.
CPC ..... *E21B 33/13* (2013.01)

(58) Field of Classification Search
CPC ..... E21B 33/13
See application file for complete search history.

(56) References Cited

U.S. PATENT DOCUMENTS

| | | | | |
|---|---|---|---|---|
| 2,754,910 | A | 7/1956 | Derrick et al. | |
| 3,595,314 | A | 7/1971 | Garner | |
| 4,244,425 | A | 1/1981 | Erbstoesser | |
| 4,505,223 | A | 3/1985 | Doner et al. | |
| 8,714,250 | B2 | 5/2014 | Baser et al. | |
| 2015/0060069 | A1* | 3/2015 | Potapenko | E21B 33/138 166/284 |

* cited by examiner

*Primary Examiner* — Caroline N Butcher
(74) *Attorney, Agent, or Firm* — Cantor Colburn LLP

(57) ABSTRACT

A method of closing a fluid flow path in a wellbore is disclosed that in one non-limiting embodiment includes: supplying a flexible structure having a selected shape sufficient to seat on an opening of the fluid flow path, the flexible structure including pores of selected dimensions; determining seating of the flexible structure on the opening of the fluid flow path from a sensor measurement; and supplying a slurry containing a sealant to the flexible structure seated on the opening of the fluid flow path to plug the pores with the sealant to close the fluid flow path.

8 Claims, 2 Drawing Sheets

APPARATUS AND METHODS FOR CLOSING FLOW PATHS IN WELLBORES

BACKGROUND

Field of the Disclosure

This disclosure relates generally to closing or sealing fluid flow paths in wellbores.

Background of the Art

Wellbores are drilled in subsurface formations for the production of hydrocarbons (oil and gas) trapped in various zones at different depths. Wellbores are often lined with a casing. The casing and the formation are perforated with a number of perforations extending through the casing to provide fluid flow paths or passage (flow paths) for the fluid to flow from the formation into the casing. Flow paths also exist in other equipment and places in the wellbore. Often it is desirable to close or seal off such flow paths. In some methods, metallic balls are pumped or dropped into the wellbore to plug the flow paths and to seal the wellbore.

The disclosure herein provides alternative structures and methods to close or seal flow paths in wellbore.

SUMMARY

In one aspect, a method of closing a fluid flow path in a wellbore is disclosed that in one non-limiting embodiment includes: supplying a flexible structure having a selected shape sufficient to seat on an opening of the fluid flow path, the flexible structure including pores of selected dimensions; determining seating of the flexible structure on the opening of the fluid flow path from a sensor measurement; and supplying a slurry containing a sealant to the flexible structure seated on the opening of the fluid flow path to plug the pores with the sealant to close the fluid flow path.

In another aspect, a method of closing a flow through path in a member in a wellbore includes: providing a structure having a first size smaller than the flow through path, wherein the structure expands to a second size that is greater than the fluid flow through path when the structure subjected to a selected condition; passing the structure through having the first size through the flow through path; subjecting the structure to the selected condition to expand the structure to the second size; and enabling the expanded structure to close the flow through path.

Examples of the more important features of the methods disclosed herein are summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
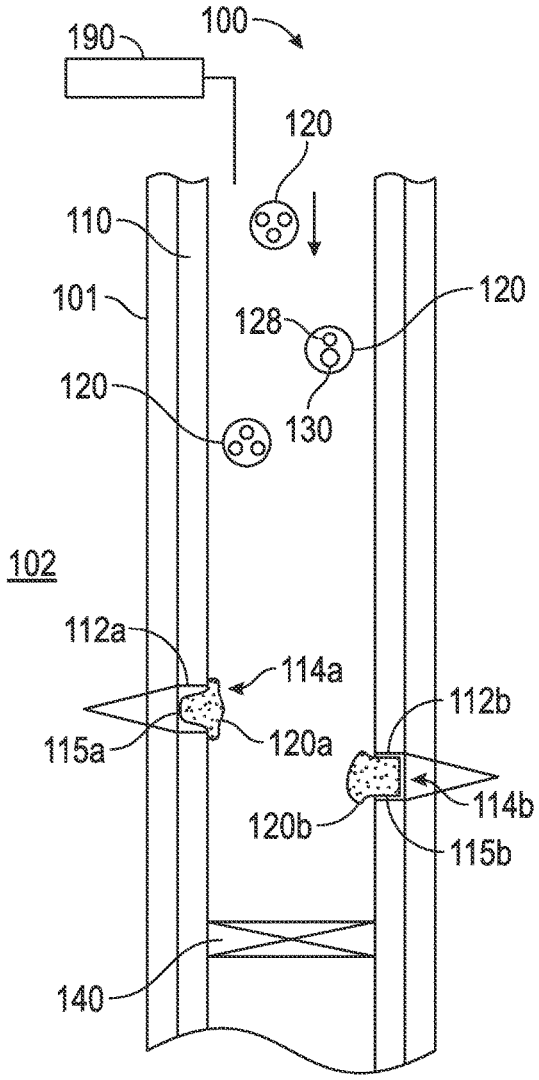
FIG. 1 shows a wellbore that includes a casing having flow through paths wherein porous flexible structures made according to a non-limiting embodiment of the disclosure have been placed on openings of the flow through paths.

FIG. 1 shows a wellbore system 100 that includes a wellbore 101 formed in a formation 102. The wellbore 101 is lined with a casing 110 that includes a number of perforations, such as perforations 112*a* and 112*b* that respectively form or provide flow through paths or passages 115*a* and 115*b* (flow paths). In a non-limiting method, flexible porous structures 120 sized to close the flow through paths 112*a* and 112*b* are pumped into the casing 104, which structures land on opening 114*a* of flow path 112*a* and opening 114*b* of flow path 112*b*. The structures 120 include pores 128 of selected or known sizes, which define the porosity of such structures. The pores 128 in structures 120 are shown in FIG. 1 as empty circles 130. Various methods of dropping or pumping balls and other structures to close flow paths in wellbores are known. Any such method or any other available method may be utilized to place or seat structures 120 on the openings 114*a* and 114*b* for the purposes of this disclosure. A barrier 140 may be placed below the flow paths 112*a* and 112*b* before pumping the structures 120 into the wellbore. Although wellbore system 100 is shown to include flow through paths formed by perforations, any other flow through paths may be closed or plugged according using the devices and methods described herein. In one embodiment, the structures 120 are flexible and larger than the openings 114*a* and 114*b* and therefore will seat on such openings as shown by structure 120*a* on opening 114*a* and 120*b* on opening 114*b*. Since structures 120*a* and 120*b* are flexible, they may be slightly deformed when placed or seated on the openings 114*a* and 114*b* as shown in FIG. 1.

Figure 2:
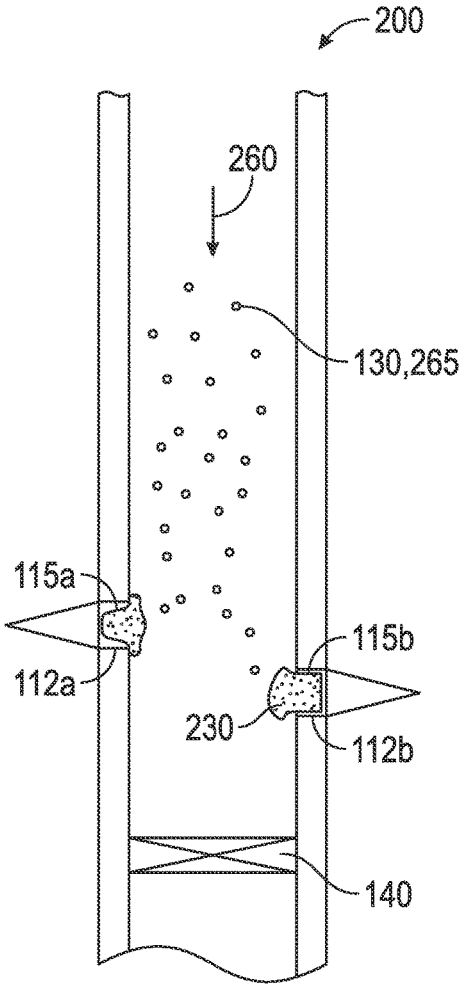
FIG. 2 shows the wellbore of FIG. 1, wherein pores of the porous flexible structures are being plugged by solid particles, according to a non-limiting method of the disclosure.

Referring now to FIGS. 1 and 2, once the structures are placed on the flow through paths 112*a* and 112*b*, the pumping pressure in the wellbore increases enabling an operator or a computer-based controller 190 at the surface to determine when the flow though paths have been plugged. Flow rate or any other suitable parameter may also be used to determine the closing of the fluid flow paths 112*a* and 112*b*. Slurry 260 containing particles 265 of materials and sizes configured to block or fill the pores 130 of the flexible porous structures 120*a*, 120*b*, etc. are then supplied or pumped to plug such pores. The slurry 260 may include one or more additives or chemicals that enable or facilitate the solid particles 265 in the slurry 260 to adhere to the pores 130 of the porous flexible structures 120*a*, 120*b* to seal the pores 130 and thus seal or plug the flow paths 112*a* and 112*b* in the wellbore, essentially sealing off the wellbore 101. In one embodiment, the structures 130 are sized to encourage such structures to lock on to the openings 114*a*, 114*b* of flow paths 115*a*, 115*b*. Slurry 260 may be pumped from a surface location or supplied downhole from pumping devices conveyed proximate to the flow paths 112*a*, 112*b*.

Thus, in one non-liming method, porous flexible structures 120 made from selected materials and of selected shapes containing pores of selected sizes are placed or seated on or urged against openings of flow paths or leak paths in a wellbore. In one non-limiting aspect, such structures are pumped into the wellbore from a surface location. In a non-limiting embodiment, the porous flexible structures include a foam material having the desired or selected flexibility and pore sizes. As such structures seat on the flow paths in the wellbore the downhole pressure increases and the flow rate decreases or stops. The increase in pressure or the decrease in the flow rate is measured at the surface or in the wellbore via known sensors. From pressure or flow rate measurements, a determination is made relating to the closures of the flow paths. Slurry containing solid particles of sizes that block or fill the pores of the flexible porous structures is then supplied to plug such pores. The slurry may include one or more additives or chemicals that enable or facilitate the solid particles in the slurry to adhere to pores of the porous flexible structures to seal the pores and thus seal or plug the flow paths or leak paths in the wellbore, sealing off the wellbore. In one non-limiting embodiment, the structures are sized to encourage such structures to lock on to the openings of the flow paths. Slurry may be pumped from a surface location or supplied downhole from pumping devices conveyed proximate to the flow paths in the wellbore.

Figure 3:
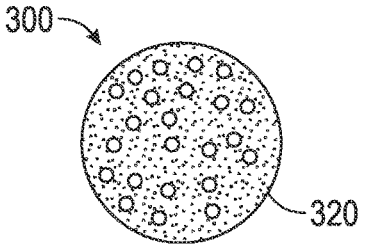
FIG. 3 shows an expandable structure made according to a non-limiting method of the disclosure for use in closing flow paths in wellbores.
Figure 4:
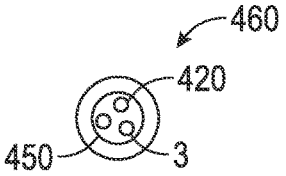
FIG. 4 shows the expandable structure of FIG. 3 in a compressed form and encapsulated in a dissolvable material for conveying such compressed structures through the flow paths in wellbores.

Referring to FIG. 3 and FIG. 4, an expandable structure 300, made according to a non-limiting method of the disclosure, may be utilized for closing flow paths in wellbores. In one aspect, the structure 300 may be made from an expandable media (material(s) that may be compressed from an expanded shape 320 to a compressed shape 420. The compressed shape 420 will expand to the original expanded shape 320 when subjected to a selected environment, such as a selected fluid, temperature, etc. Any suitable material may be used for structure 300, including, but not limited to, available shape memory materials. FIG. 4 shows the structure after it has been compressed to attain the compressed shape 420. In one non-limiting embodiment, structure 420 is encapsulated in a suitable temporary material 450 (encapsulation) which may be breakable or dissolvable material or membrane of size and shape that would enable the resulting structures 460 to flow through target flow paths. A non-limiting method for sealing flow though paths using structures of FIGS. 3 and 4 is described in reference to FIGS. 5 and 6.

Figure 5:
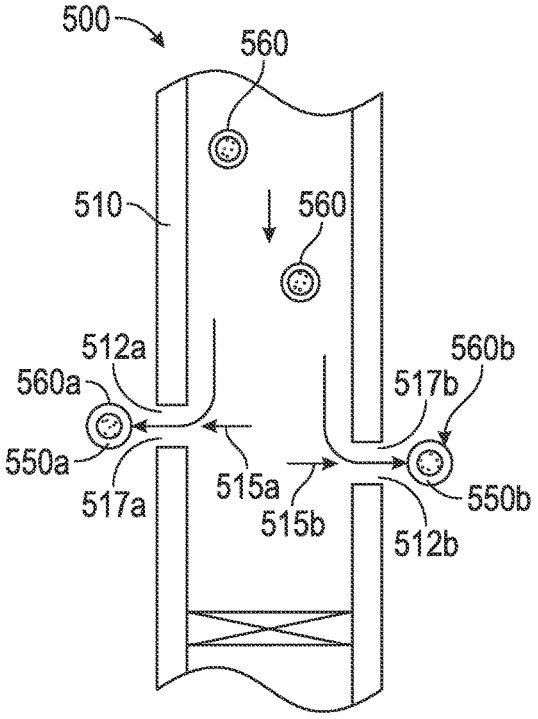
FIG. 5 shows a wellbore that includes a casing having flow through paths, wherein encapsulated structures shown in FIG. 4 have been passed through the flow through paths, according to a non-limiting method of the disclosure.

FIG. 5 shows a wellbore system 500 that includes a casing 510 that includes a number of perforations, such as perforations 512*a* and 512*b*, etc. that respectively form or provide flow through paths or passages 515*a* and 515*b*. In a non-limiting method expandable encapsulated compressed structures 460 having dimensions smaller than the flow through paths 515*a* and 515*b* are pumped into the casing 510 to cause such structures to pass through the passages 515*a* and 515*b*. In FIG. 5 a particular encapsulated compressed structure 560*a* is shown past the flow through path 515*a* and as structure 560*b* past the path 515*b*. Structures 460 may be pumped or conveyed into the casing by ay available method.

Figure 6:
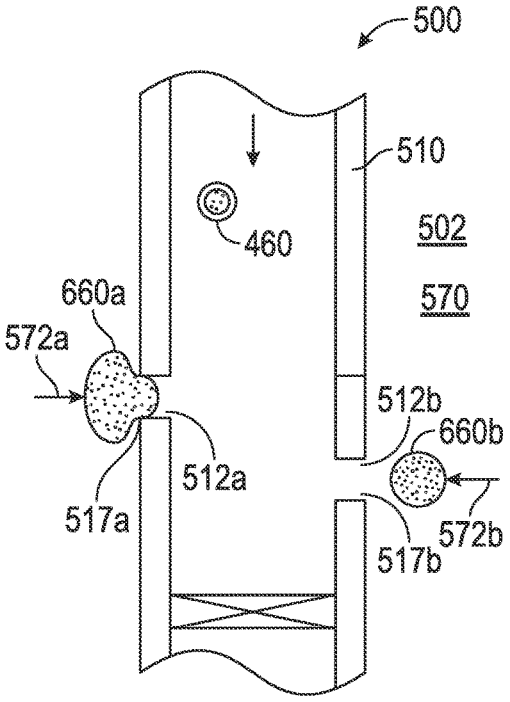
FIG. 6 shows the wellbore of FIG. 5, wherein the structures shown in FIG. 5 have been expanded and are in the process of closing the flow through paths, according to a non-limiting embodiment of the disclosure.

After a period of time in the wellbore, the encapsulation 550*a* of structure 560*a* and 550*b* of structure 560*b* would dissolve or break allowing the compressed expandable structure 560*a* to expand to a size greater than the back opening 517*a* of flow path 515*a* and structure 560*b* would expand to a size greater than the back opening 517*b* of flow path 515*b*. FIG. 6 shows structure 660*a* as an expanded structure 560*a* shown in FIG. 5 past the flow path 515*a* and structure 660*b* as an expanded structure 560*b* past the flow path 515*b*. After the structures 660*a* and 660*b* have expanded to their desired dimensions, the pumping pressure in the casing is reduced, which allows formation fluid 570 to flow from the formation 502 back toward the casing 510 as shown by arrows 572, causing the expanded structures 660*a* and 660*b* to respectively seat on the back openings 517*a* and 517*b* and close the flow through paths 515*a* and 515*b*. The pressure of the formation 502 will remain above the pressure in the casing 510, thereby enabling the structures 660*a* and 660*b* to seal the flow paths 515*a* and 515*b*, thereby sealing the wellbore.

Thus in another embodiment, the structures for sealing the flow paths may be made from an expandable media (material(s)) and encapsulated in a temporary (breakable or dissolvable) membrane of sizes and shapes that would enable the resulting structures or bodies to flow through the target flow paths. After a period of time, the encapsulation degrades and allows the expandable media to expand to a size greater than the opening in the flow path. Fluid from the formation will then attempt to flow back through the fluid flow paths (i.e., in the reverse direction of the direction in which the structures were pumped), which fluid may include the fluid injected with the structures through the flow paths to the formation. The flow back fluid causes the expanded structures to flow back to the openings of the flow paths and plug the fluid flow paths. In various embodiments, the expanding media may include any suitable swellable material, including, but not limited to, swellable rubber and foam, etc., encapsulated in a temporary membrane. The resulting structures or capsules are sized so that they can be pumped through the flow paths. The temporary membrane may be made from a material that will dissolve or be removed when in the wellbore through any means, including, but not limited to, thermal degradation, solubility and corrosion.

Still referring to FIGS. 5 and 6, a fluid or agent or accelerant configured to degrade or dissolve the encapsulations of structures 560 may be pumped into the formation 502 prior to pumping the encapsulated structures 560 into the wellbore. Such fluid would degrade the encapsulations once such structures pass through the flow through passages 515*a* and 515*b*, enabling the structures to expand and then seal the flow through passages as described above.

The foregoing disclosure is directed to certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A method of closing a fluid flow path of a casing in a wellbore in a formation, the method comprising:

providing a structure having a first size smaller than the fluid flow path within the casing, wherein the structure expands to a second size that is greater than the fluid flow path when the structure is subjected to a selected condition;

passing the structure through the fluid flow path of the casing to a location outside the casing;

subjecting the structure to the selected condition to expand the structure to the second size; and allowing a formation fluid to flow from the formation toward the casing to seat the expanded structure in the fluid flow path of the casing to close the fluid flow path.

2. The method of claim 1, wherein passing the structure through the fluid flow path comprises pumping the structure through the fluid flow path with a fluid and wherein flow back of such fluid enables the expanded structure to close the fluid flow path.

3. The method of claim 1, wherein the structure includes an expandable core and a degradable encapsulation on the expandable core.

4. The method of claim 3 further comprising pumping a fluid through the fluid flow path configured to degrade the encapsulation.

5. The method of claim 3, wherein the encapsulation degrades due to one selected from the group consisting of: (i) thermal degradation in the wellbore; (ii) solubility of the encapsulation in fluid present in the wellbore; (iii) corrosion due to the downhole environment; and (iv) subjecting the encapsulation to a selected fluid.

6. The method of claim 1, wherein passing the structure through the fluid flow path comprises pumping the structure with a fluid though the fluid flow path and enabling the expanded structure to close the fluid flow path comprises a fluid flow back into the fluid flow path.

7. A wellbore system, comprising:

a casing in the wellbore that includes a flow through passage that has been plugged by passing a structure through the flow through passage to a location outside the casing, expanding the structure after it has passed through the flow through passage to a size greater than the size of the flow through passage and allowing a formation fluid to flow from a formation toward the casing to seat the expanded structure in the flow through passage to plug the flow through passage.

8. The apparatus of claim 7, wherein the structure includes an expandable material.

* * * * *